US007443108B2

(12) United States Patent
Meng et al.

(10) Patent No.: US 7,443,108 B2
(45) Date of Patent: Oct. 28, 2008

(54) APPARATUS FOR DRIVING A PLURALITY OF LAMPS

(75) Inventors: Tien-Hsiang Meng, Shenzhen (CN); Chi-Hsiung Lee, Shenzhen (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 228 days.

(21) Appl. No.: 11/309,108

(22) Filed: Jun. 23, 2006

(65) Prior Publication Data

US 2007/0126369 A1 Jun. 7, 2007

(30) Foreign Application Priority Data

Dec. 2, 2005 (TW) ..... 94142452 A

(51) Int. Cl.
*H05B 41/16* (2006.01)

(52) U.S. Cl. ..... 315/276; 315/277; 315/282; 315/312

(58) Field of Classification Search ..... 315/246, 315/276–277, 282–283, 291, 299, 307–308, 315/312

See application file for complete search history.

(56) References Cited

U.S. PATENT DOCUMENTS 6,362,577 B1 3/2002 Ito et al.
6,717,372 B2 4/2004 Lin et al.
6,781,325 B2 8/2004 Lee
7,291,987 B2 * 11/2007 Chang et al. ..... 315/282
2004/0066151 A1 * 4/2004 Kang et al. ..... 315/276
2005/0093484 A1 * 5/2005 Ball ..... 315/291
2005/0099143 A1 * 5/2005 Kohno ..... 315/312
2005/0146286 A1 7/2005 Chan et al.
2005/0156542 A1 * 7/2005 Lin ..... 315/312
2006/0113926 A1 * 6/2006 Lin ..... 315/291
2007/0007910 A1 * 1/2007 Kim et al. ..... 315/282
2007/0273303 A1 * 11/2007 Wey et al. ..... 315/294

* cited by examiner

*Primary Examiner*—David H Vu
*Assistant Examiner*—Tung X Le
(74) *Attorney, Agent, or Firm*—Wei Te Chung

(57) ABSTRACT

A power system for driving a plurality of lamps includes a transformer circuit, a current balancing circuit, and a light source. The transformer circuit includes a plurality of transformers in a quantity denoted by N, and each of the transformers has a first, a second, a third, and a fourth output ends. The current balancing circuit includes a plurality of current balancing units each having two output ends. The 2Nth current balancing unit is connected to a fourth output end of the Nth transformer, and the (2N−1)th current balancing unit is connected to a first output end of the Nth transformer. The light source has a plurality of lamps each having one end connected to a respective output end of the current balancing units and another end grounded. The numbers of the current balancing units and the lamps are respectively twice and four times the quantity N of the transformers.

20 Claims, 6 Drawing Sheets

APPARATUS FOR DRIVING A PLURALITY OF LAMPS

FIELD OF THE INVENTION

The invention relates to electrical power systems, and particularly to an apparatus for driving a plurality of lamps.

DESCRIPTION OF RELATED ART

Discharge lamps, especially cold cathode fluorescent lamps (CCFLs), are used as light sources for Liquid Crystal Display (LCD) panels. Typically, CCFLs are driven by inverter circuits. An inverter circuit provides alternating current signals to CCFLs, and includes a feedback control circuit to maintain stability of current flowing through the CCFLs. For larger LCD panels, two or more CCFLs are typically required to provide sufficient luminance.

FIG. 6 is a schematic diagram of a conventional power system for driving multiple lamps. As depicted in FIG. 6, the power system includes a direct current (DC) power source Vc, a converter circuit 100, a control circuit 110, a plurality of feedback circuits 120, a plurality of transformers T11, T12, T13, and T14, a plurality of capacitors C11, C12, C13, and C14, and a plurality of lamps Lp11, Lp12, Lp13, and Lp14. The converter circuit 100 converts a DC signal from the DC power source Vc to an alternating current (AC) signal. The control circuit 110 controls the converter circuit 100 to convert the DC signal to the AC signal. The feedback circuits 120 respectively feedback a current signal from a corresponding lamp Lp11, Lp12, Lp13, and Lp14 to the control circuit 110. The transformers T11, T12, T13, and T14 are connected to the converter circuit 100, and each transformer has a secondary winding including one end connected to an end of each of the corresponding capacitors C11, C12, C13, and C14 and the other end grounded. The other ends of the capacitors C11, C12, C13, and C14 are respectively connected to the lamps Lp11, Lp12, Lp13, and Lp14.

As shown in FIG. 6, the currents through the lamps Lp11, Lp12, Lp13, and Lp14 can be balanced by the transformers T11, T12, T13, and T14 with same features. However, since many transformers are required for balancing currents of a plurality of lamps, both the size and the cost of the conventional power system are increased accordingly.

Another conventional power system for driving multiple lamps uses one transformer to drive two lamps, and currents flowing through the two lamps are balanced by a common mode choke. However, the size of the conventional power system is also big, and the cost thereof is also high, if a plurality of lamps are required to be powered.

SUMMARY OF THE INVENTION

An embodiment of the invention provides a power system for driving a plurality of lamps. The power system includes a transformer circuit, a current balancing circuit, and a light source. The transformer circuit includes a plurality of transformers in quantity N. Each of the transformers has a first secondary winding, having a first output end and a second output end, and a second secondary winding, having a third output end and a fourth output end. The current balancing circuit includes a plurality of current balancing units, which are twice the quantity N of the transformers, and each current balancing unit has two output ends. The 2Nth current balancing unit is connected to a fourth output end of the Nth transformer, and the (2N−1)th current balancing unit is connected to a first output end of the Nth transformer. The light source has a plurality of lamps, which are four times the quantity N of the transformers, and each of the lamps has one end connected to a respective output end of the current balancing units and another end grounded.

Another embodiment of the invention provides a power system for driving a plurality of lamps. The power system includes a transformer circuit, a current balancing circuit, and a light source. The transformer circuit includes a plurality of transformers in quantity N. Each of the transformers has a first secondary winding, having a first output end and a second output end, a second secondary winding, having a third output end and a fourth output end, and a third secondary winding, having a fifth output end and a sixth output end. The current balancing circuit includes a plurality of current balancing units, respectively having two output ends, and the number of the current balancing units are three times the quantity N of the transformers. The 3Nth current balancing unit is connected to a fifth output end of the Nth transformer, the (3N−1)th current balancing unit is connected to a third output end of the Nth transformer, and the (3N−2)th current balancing unit is connected to a first output end of the Nth transformer. The light source has a plurality of lamps, which are six times the quantity N of the transformers, and each of the lamps has one end connected to a respective output end of the current balancing units and another end grounded.

Other advantages and novel features will become more apparent from the following detailed description when taken in conjunction with the accompanying drawings. Like reference numerals denote like components throughout the several views.

DETAILED DESCRIPTION OF THE INVENTION

Figure 1:
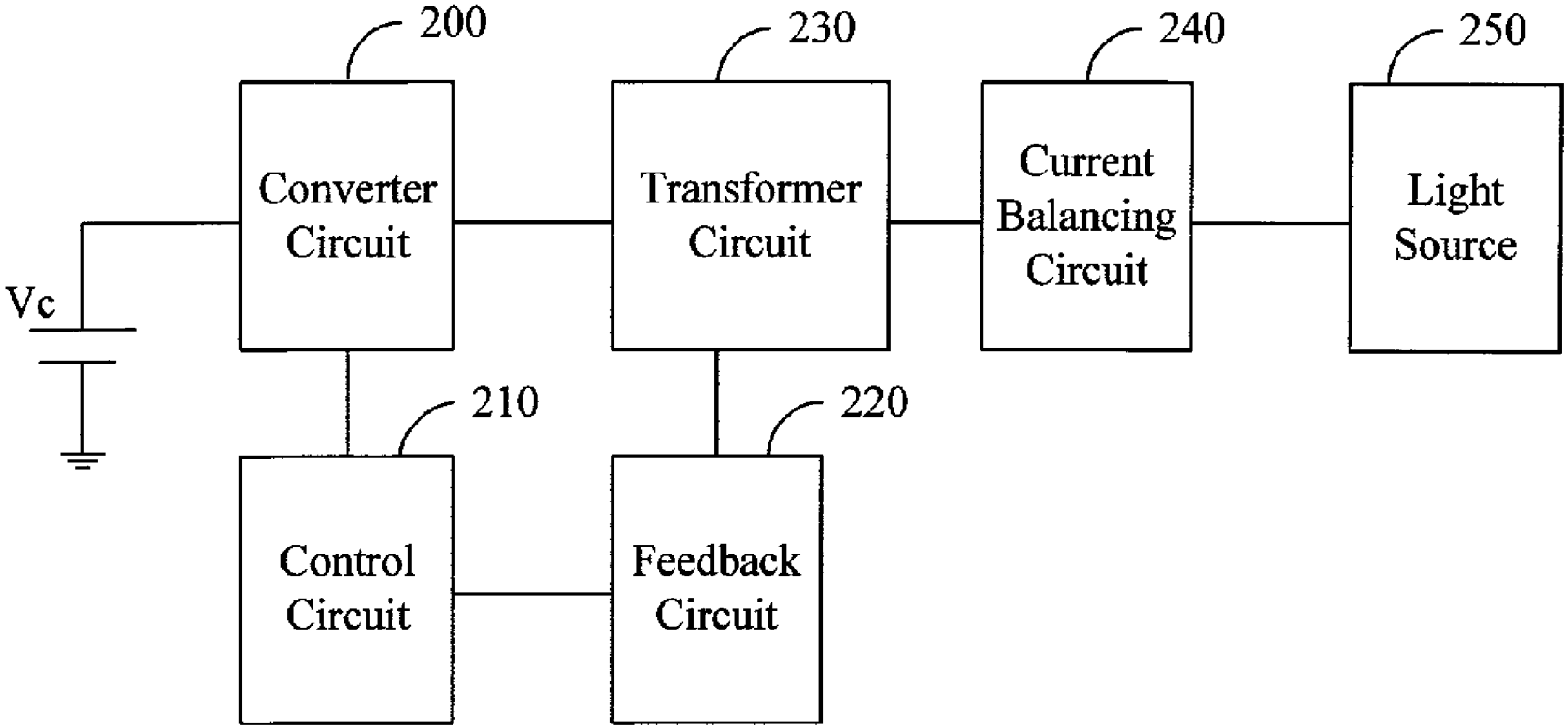
FIG. 1 is a schematic diagram of a power system for driving a plurality of lamps in accordance with an embodiment of the invention.

FIG. 1 is a schematic diagram of a power system for driving a plurality of lamps (hereinafter the power system) in accordance with an embodiment of the invention. In the embodiment, the power system includes a direct current (DC) power source Vc, a converter circuit 200, a control circuit 210, a feedback circuit 220, a transformer circuit 230, a current balancing circuit 240, and a light source 250 including a plurality of lamps. The power system is used for driving the lamps of the light source 250. The converter circuit 200 converts a direct current (DC) signal from the DC power source Vc to an alternating current (AC) signal. The converter circuit 200 may comprise a half-bridge converter circuit, a full-bridge converter circuit, or a push-pull converter circuit. The control circuit 210 controls the converter circuit 200 to convert the DC signal to the AC signal. The transformer circuit 230 is connected to the converter circuit 200, and transforms a voltage level of the AC signal to provide enough power for the light source 250. The current balancing circuit 240 is connected between the transformer circuit 230 and the light source 250, and balances currents flowing through the lamps of the light source 250. The feedback circuit 220 is connected to the transformer circuit 230 and the control circuit 210 to feed a current signal to the control circuit 210.

Figure 2:
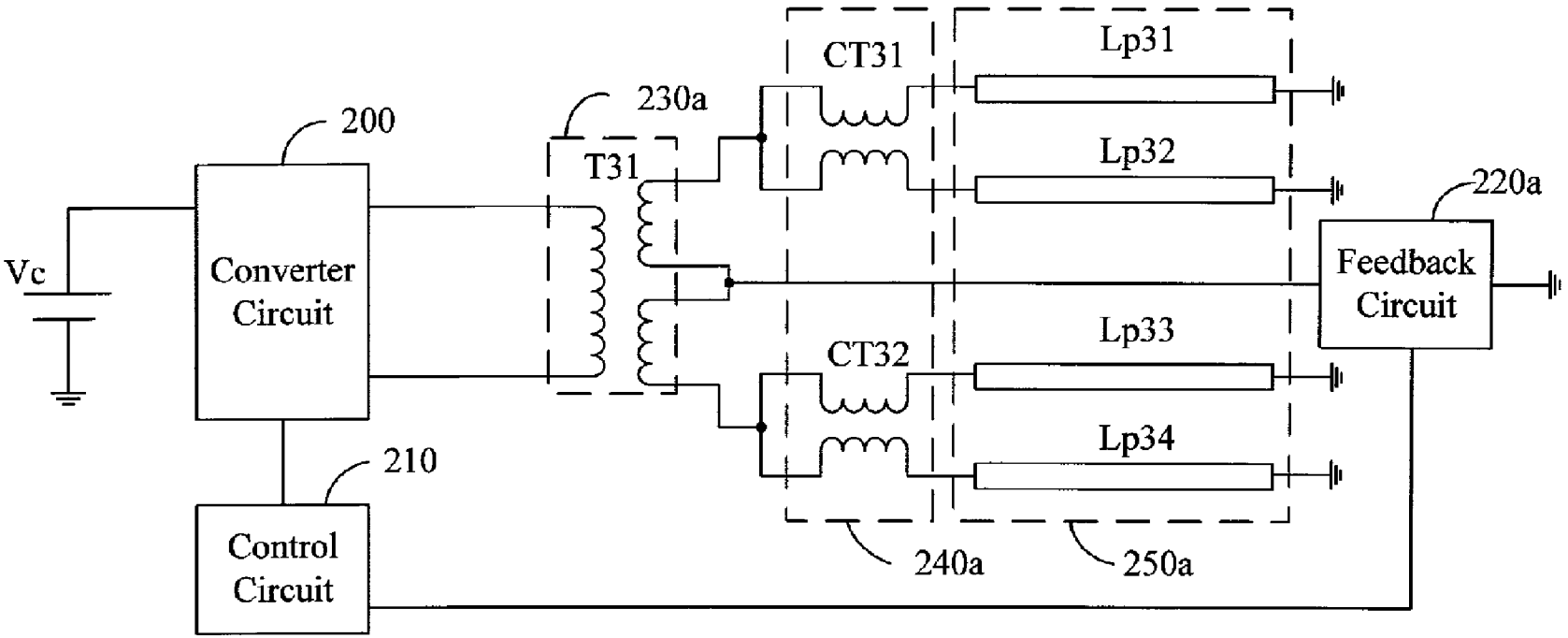
FIG. 2 shows a circuit diagram of FIG. 1.

FIG. 2 shows an exemplary circuit diagram of FIG. 1. In this embodiment, a light source 250*a* includes four lamps Lp31, Lp32, Lp33, and Lp34. A transformer circuit 230*a* includes a transformer T31, and the transformer T31 includes a primary winding, a first secondary winding, and a second secondary winding. The primary winding of the transformer T31 is connected to the converter circuit 200, the first secondary winding has a first output end and a second output end, and the second secondary winding has a third output end and a fourth output end. In the embodiment, the number of turns of the first and the second secondary windings are the same.

A current balancing circuit 240*a* includes two current balancing units CT31 and CT32. The current balancing unit CT31 is connected to the first output end of the transformer T31, and the current balancing unit CT32 is connected to the fourth output end of the transformer T31. The second output end and the third output end of the transformer T31 are commonly connected to the feedback circuit 220*a*. The current balancing units CT31 and CT32 each has two input ends and two output ends. The two input ends of the current balancing unit CT31 are commonly connected to the first output end of the transformer T31. The two input ends of the current balancing unit CT32 are commonly connected to the fourth output end of the transformer T31. The output ends of the current balancing units CT31 and CT32 are respectively connected to a corresponding one of the lamps of the light source 250*a*. That is, one end of the lamp Lp31 is connected to one output end of the current balancing unit CT31, and one end of the lamp Lp32 is connected to the other output end of the current balancing unit CT31. One end of the lamp Lp33 is connected to one output end of the current balancing unit CT32, and one end of the lamp Lp34 is connected to the other output end of the current balancing unit CT32. The other ends of the lamps Lp31, Lp32, Lp33, and Lp34 are grounded.

The current balancing units CT31 and CT32 are the same, each having two magnetic windings with the same number of turns. In the exemplary embodiment, the current balancing units CT31 and CT32 are common mode chokes.

Because the first secondary winding and the second secondary winding of the transformer T31 have the same number of turns, currents flowing therethrough are the same. In addition, the magnetic windings of the current balancing units CT31 and CT32 have the same number of turns, so currents flowing therethrough are the same. Thus, currents flowing through the lamps Lp31, Lp32, Lp33, and Lp34 of the light source 250*a* are balanced. In the exemplary embodiment, the power system utilizes one transformer and two current balancing units to drive four lamps, and thus, the power system has smaller size and lower cost.

Figure 3:
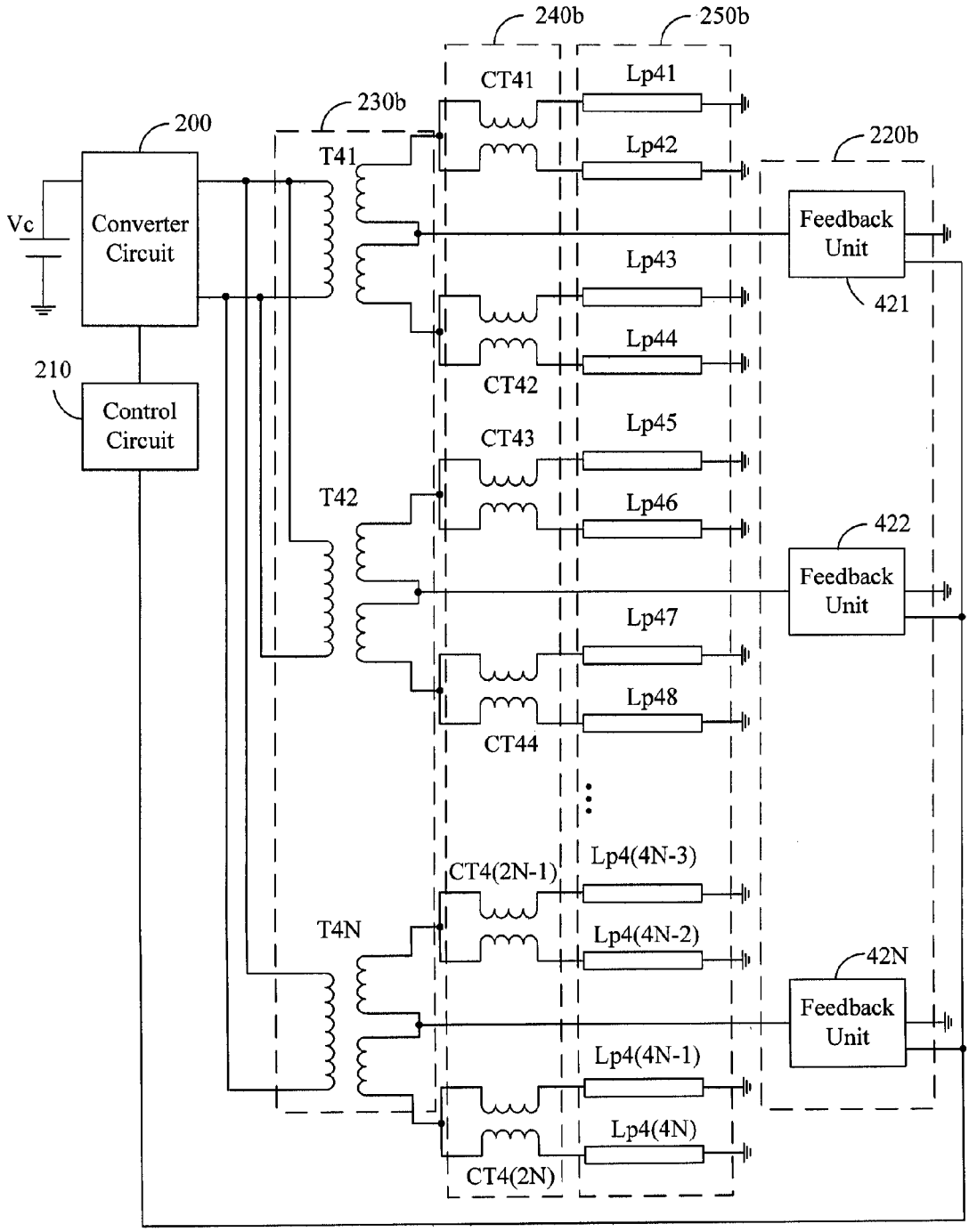
FIG. 3 shows an alternative circuit diagram of FIG. 1.

FIG. 3 shows an alternative exemplary circuit diagram of FIG. 1. In the embodiment, the power system drives a plurality of lamps. A light source 250*b* of the power system includes a plurality of lamps Lp41, Lp42, . . . , and Lp4(4N). The quantity of the transformers is denoted by the symbol N, and the number of the lamps is four times the quantity N of the transformers. A transformer circuit 230*b* includes a plurality of same transformers T41, T42, . . . , and T4N, and each of the transformers T41, T42, . . . , and T4N includes a primary winding, a first secondary winding, and a second secondary winding. The transformers T41, T42, . . . , and T4N are connected to the converter circuit 200 in parallel, that is, the primary winding of the transformers T41, T42, . . . , and T4N are connected in parallel. In an alternative embodiment, the transformers T41, T42, . . . , and T4N may be connected to the converter circuit 200 in series. The first secondary windings of the transformers T41, T42, . . . , and T4N respectively have a first output end and a second output end, and the second secondary windings thereof each has a third output end and a fourth output end. The first secondary windings and the second secondary windings of the transformers T41, T42, . . . , and T4N have the same number of turns.

A feedback circuit 220*b* includes a plurality of feedback units 421, 422, . . . , and 42N, and the feedback units 421, 422, . . . , and 42N respectively feed current signals to the control circuit 210. The number of the feedback units is the same as the quantity N of the transformers.

A current balancing circuit 240*b* includes a plurality of current balancing units CT41, CT42, . . . , and CT4(2N). The number of the current balancing units is twice the quantity N of the transformers. The current balancing unit CT41 is connected to the first output end of the transformer T41, the current balancing unit CT42 is connected to the fourth output end of the transformer T41, and the second output end and the third output end of the transformer T41 are commonly connected to the feedback unit 421. The current balancing unit CT43 is connected to the first output end of the transformer T42, the current balancing unit CT44 is connected to the fourth output end of the transformer T42, and the second output end and the third output end of the transformer T42 are commonly connected to the feedback unit 422; and so on through to the Nth transformer. That is, the current balancing unit CT4(2N−1) is connected to the first output end of the transformer T4N, the current balancing unit CT4(2N) is connected to the fourth output end of the transformer T4N, and the second output end and the third output end of the transformer T4N are commonly connected to the feedback unit 42N.

Each of the current balancing units CT41, CT42, . . . , and CT4(2N) includes two input ends and two output ends, and the two input ends thereof are respectively connected together. Each of the lamps Lp41, Lp42, . . . , and Lp4(4N) has one end connected to a corresponding output end of the current balancing units CT41, CT42, . . . , and CT4(2N). That is, the lamp Lp41 has one end connected to one output end of the current balancing unit CT41, the lamp Lp42 has one end connected to the other output end of the current balancing unit CT41, the lamp Lp43 has one end connected to one output end of the current balancing unit CT42, the lamp Lp44 has one end connected to the other output end of the current balancing unit CT42, and so on through to the (4N)th lamp. That is, the lamp Lp4(4N−3) has one end connected to one output end of the current balancing unit CT4(2N−1), the lamp Lp4(4N−2) has one end connected to the other output end of the current balancing unit CT4(2N−1), the lamp Lp4(4N−1) has one end connected to one output end of the current balancing unit CT4(2N), and the lamp Lp4(4N) has one end connected to the other output end of the current balancing unit CT4(2N). The other ends of the lamps Lp41, Lp42, . . . , and Lp4(4N) are grounded.

The current balancing units CT41, CT42, . . . , and CT4(2N) are the same, and each has two magnetic windings. The numbers of turns of the magnetic windings are the same. In the exemplary embodiment, the current balancing units CT41, CT42, . . . , and CT4(2N) may be common mode chokes.

Because the transformers T41, T42, . . . , and T4N are the same, and the first and the second secondary windings thereof have the same number of turns, currents flowing therethrough are the same. In addition, because the magnetic windings of the current balancing units CT41, CT42, . . . , and CT4(2N) have the same number of turns, currents flowing therethrough are the same. Thus, current flowing through the lamps Lp41, Lp42, . . . and Lp4(4N) are balanced.

Figure 4:
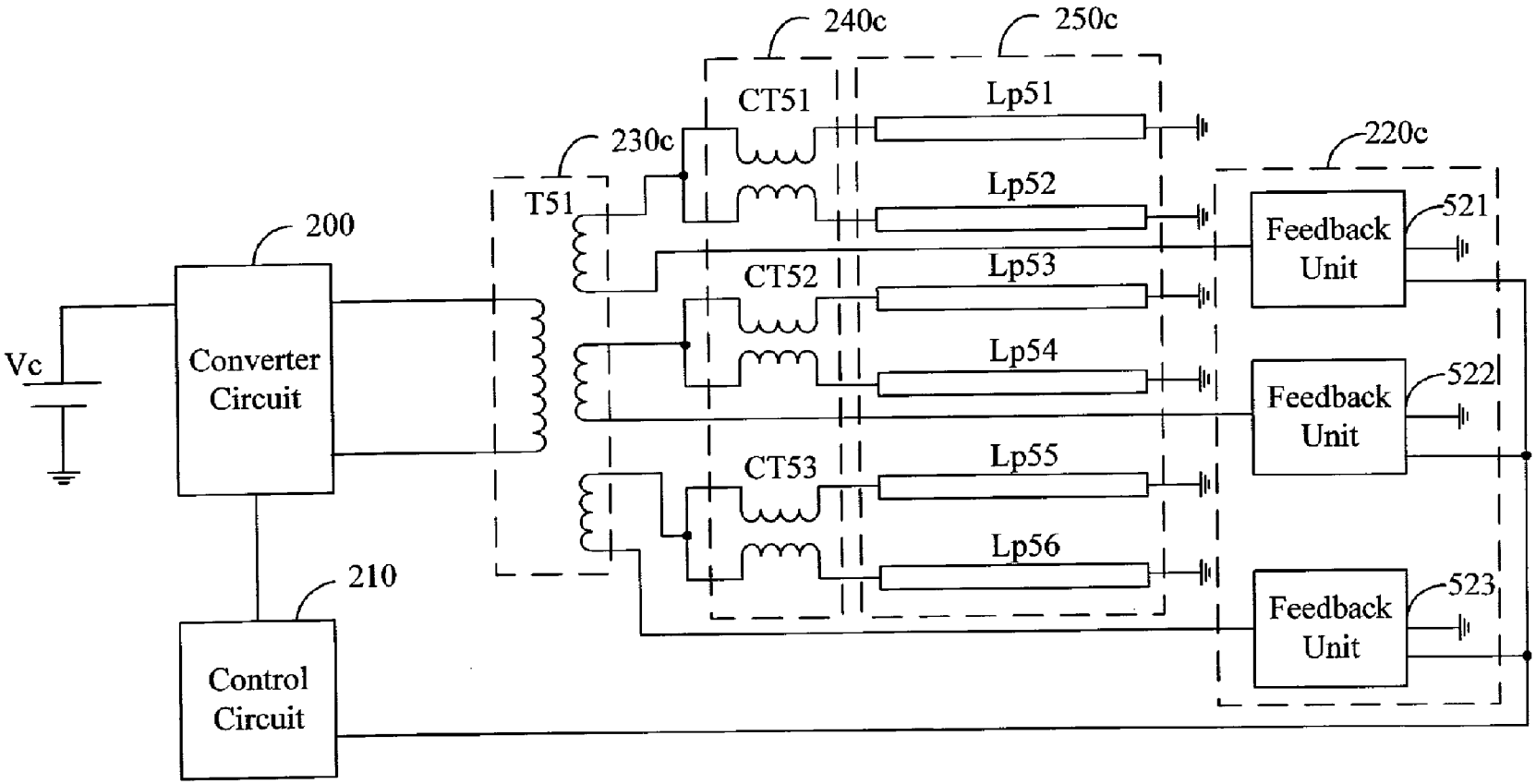
FIG. 4 shows a further alternative circuit diagram of FIG. 1.

FIG. 4 shows a further alternative exemplary circuit diagram of FIG. 1. In this embodiment, a light source 250*c* includes six lamps Lp51, Lp52, Lp53, Lp54, Lp55, and Lp56. A transformer circuit 230*c* includes one transformer T51, and the transformer T51 includes a primary winding, a first secondary winding, a second secondary winding, and a third secondary winding. The primary winding of the transformer T51 is connected to the converter circuit 200, the first secondary winding has a first output end and a second output end, the second secondary winding has a third output end and a fourth output end, and the third secondary winding has a fifth output end and a sixth output end. In the embodiment, number of turns of the first, the second, and the third secondary windings are the same.

A feedback circuit 220*c* includes three feedback units 521, 522, and 523 for feeding current signals to the control circuit 210. A current balancing circuit 240*c* includes three current balancing units CT51, CT52, and CT53. The current balancing unit CT51 is connected to the first output end of the transformer T51, the current balancing unit CT52 is connected to the third output end of the transformer T51, and the current balancing unit CT53 is connected to the fifth output end of the transformer T51. The second, the fourth, and the sixth output ends of the transformer T51 are connected to a corresponding one of the feedback units 521, 522, and 523. In an alternative embodiment, the current balancing units CT51, CT52, and CT53 may be correspondingly connected to the second, the fourth, and the sixth output ends of the transformer T51.

The current balancing units CT51, CT52, and CT53 each has two input ends and two output ends. The two input ends of the current balancing unit CT51 are commonly connected to the first output end of the transformer T51. The two input ends of the current balancing unit CT52 are commonly connected to the third output end of the transformer T51. The two input ends of the current balancing unit CT53 are commonly connected to the fifth output end of the transformer T51. The output ends of the current balancing units CT51, CT52, and CT53 are respectively connected to a corresponding one of the lamps of the light source 250*c*. That is, one end of the lamp Lp51 is connected to one output end of the current balancing unit CT51, and one end of the lamp Lp52 is connected to the other output end of the current balancing unit CT51. One end of the lamp Lp53 is connected to one output end of the current balancing unit CT52, and one end of the lamp Lp54 is connected to the other output end of the current balancing unit CT52. One end of the lamps Lp55 is connected to one output end of the current balancing unit CT53, and one end of the lamps Lp56 is connected to the other output end of the current balancing unit CT53. The other ends of the lamps Lp51, Lp52, Lp53, Lp54, Lp55, and Lp56 are grounded.

The current balancing units CT51, CT52, and CT53 are the same, each including two magnetic windings having the same numbers of turns. In the exemplary embodiment, the current balancing units CT51, CT52, and CT53 may be common mode chokes.

Because the first, the second, and the third secondary windings of the transformer T51 have the same number of turns, currents flowing therethrough are the same. In addition, the magnetic windings of the current balancing units CT51, CT52, and CT53 have the same number of turns, current flowing therethrough are the same. Thus, currents flowing through the lamps Lp51, Lp52, Lp53, Lp54, Lp55, and Lp56 of the light source 250*c* are balanced. In the exemplary embodiment, the power system utilizes one transformer and three current balancing units to drive six lamps, and thus, the power system has smaller size and lower cost.

Figure 5:
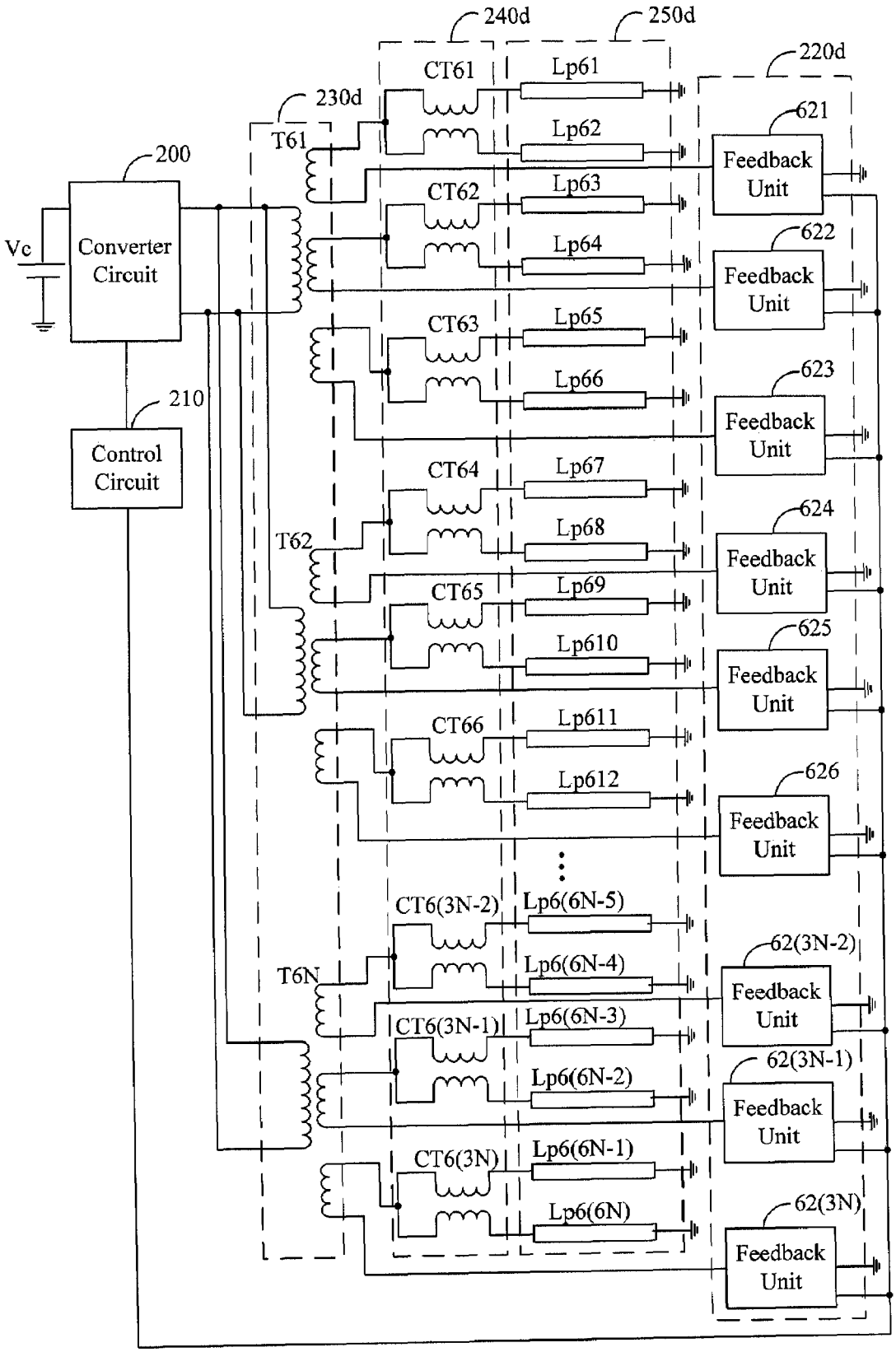
FIG. 5 shows a still further alternative circuit diagram of FIG. 1.
Figure 6:
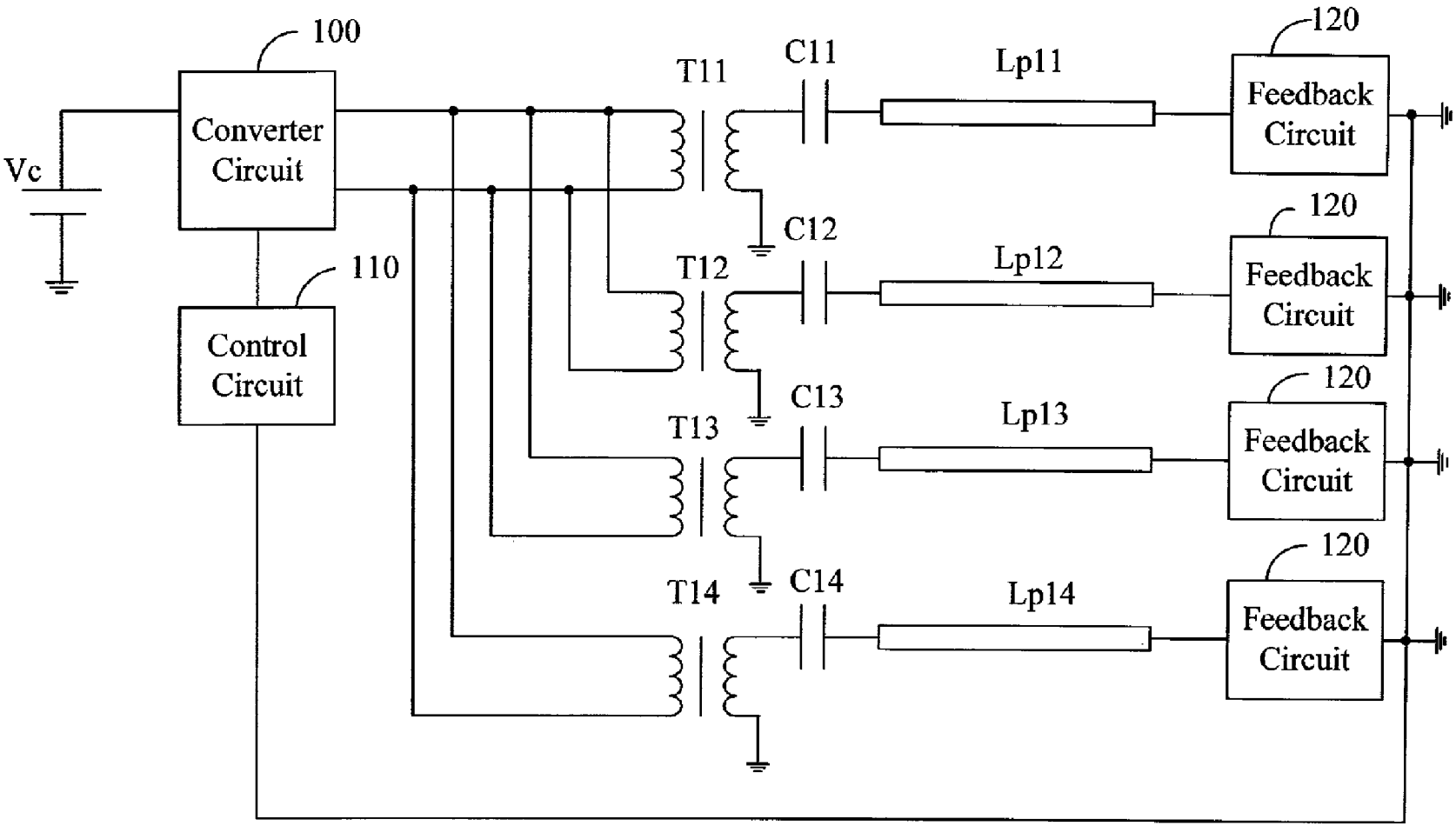
FIG. 6 (Related Art)
FIG. 6 is a schematic diagram of a conventional power system for diving plural lamps.

FIG. 5 shows a further alternative exemplary circuit diagram of FIG. 1. In the embodiment, the power system drives a greater number of lamps. A light source 250*d* of the power system includes a plurality of lamps Lp61, Lp62, . . . , and Lp6(6N). A transformer circuit 230*d* includes a plurality of same transformers T61, T62, . . . , and T6N. The quantity of the transformers is denoted by the symbol N, and the number of the lamps is six times the quantity N of the transformers. Each of the transformers T61, T62, . . . , and T6N includes a primary winding, a first secondary winding, a second secondary winding, and a third secondary winding. The transformers T61, T62, . . . , and T6N are connected to the converter circuit 200 in parallel, that is, the primary winding of the transformers T61, T62, . . . , and T6N are connected in parallel. In an alternative embodiment, the transformers T61, T62, . . . , and T6N may be connected to the converter circuit 200 in series. The first secondary windings of the transformers T61, T62, . . . , and T6N each has a first output end and a second output end, the second secondary windings thereof each has a third output end and a fourth output end, and the third secondary windings thereof each has a fifth output end and a sixth output end. The first, the second, and the third secondary windings of the transformers T61, T62, . . . , and T6N have the same number of turns.

A feedback circuit 220*d* includes plural feedback units 621, 622, . . . , and 62(3N), and the feedback units 621, 622, . . . , and 62(3N) respectively feed current signals to the control circuit 210. The number of the feedback units is three times the quantity N of the transformers.

A current balancing circuit 240*d* includes a plurality of current balancing units CT61, CT62, . . . , and CT6(3N). The number of the current balancing units is three times the quantity N of the transformers. The current balancing unit CT61 is connected to the first output end of the transformer T61, the current balancing unit CT62 is connected to the third output end of the transformer T61, the current balancing unit CT63 is connected to the fifth output end of the transformer T61, and the second output end, the fourth output end, and the sixth output end of the transformer T61 are respectively connected to the feedback units 621, 622, and 623. The current balancing unit CT64 is connected to the first output end of the transformer T62, the current balancing unit CT65 is connected to the third output end of the transformer T62, the current balancing unit CT66 is connected to the fifth output end of the transformer T62, and the second output end, the fourth output end, and the sixth output end of the transformer T62 are respectively connected to the feedback units 624, 625, and 626; and so on through to the Nth lamp. That is, the current balancing unit CT6(3N−2) is connected to the first output end of the transformer T6N, the current balancing unit CT6(3N−1) is connected to the third output end of the transformer T6N, the current balancing unit CT6(3N) is connected to the fifth output end of the transformer T6N, and the second output end, the fourth output end, and the sixth output end of the transformer T6N are respectively connected to the feedback units 62(3N−2), 62(3N−1), and 62(3N).

Each of the current balancing units CT61, CT62, . . . , and CT6(3N) includes two input ends and two output ends, and the two input ends thereof are respectively connected together. Each of the lamps Lp61, Lp62, . . . , and Lp6(6N) has one end connected to a corresponding output end of the current balancing units CT61, CT62, . . . , and CT6(3N). That is, the lamp Lp61 has one end connected to one output end of the current balancing unit CT61, and the lamp Lp62 has one end connected to the other output end of the current balancing unit CT61. The lamp Lp63 has one end connected to one output end of the current balancing unit CT62, and the lamp Lp64 has one end connected to the other output end of the current balancing unit CT62. The lamp Lp65 has one end connected to one output end of the current balancing unit CT63, and the lamp Lp66 has one end connected to the other output end of the current balancing unit CT63; and so on through to the Nth lamp. That is, the lamp Lp6(6N−5) has one end connected to one output end of the current balancing unit CT6(3N−2), and the lamp Lp6(6N−4) has one end connected to the other output end of the current balancing unit CT6(3N−2). The lamp Lp6(6N−3) has one end connected to one output end of the current balancing unit CT6(3N−1), and the lamp Lp6(6N−2) has one end connected to the other output end of the current balancing unit CT6(3N−1). The lamp Lp6(6N−1) has one end connected to one output end of the current balancing unit CT6(3N), and the lamp Lp6(6N) has one end connected to the other output end of the current balancing unit CT6(3N). The other ends of the lamps Lp61, Lp62, . . . , and Lp6(6N) are grounded.

The current balancing units CT61, CT62, . . . , and CT6(3N) are the same, and respectively have two magnetic windings. The number of turns of the magnetic windings are the same. In the exemplary embodiment, the current balancing units CT61, CT62, . . . , and CT6(3N) may be common mode chokes.

Because the transformers T61, T62, . . . , and T6N are the same, and the first, the second, and the third secondary windings thereof have the same number of turns, currents flowing therethrough are the same. In addition, because the magnetic windings of the current balancing units CT61, CT62, . . . , and CT6(3N) have the same number of turns, currents flowing therethrough are the same. Thus, currents flowing through the lamps Lp61, Lp62, . . . , and Lp6(6N) are balanced.

The above mentioned power system balances current flowing through the plurality of lamps, and is smaller in size and lower in cost.

The foregoing disclosure of various embodiments has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto and their equivalents.

What is claimed is:

1. A power system for driving a plurality of lamps, comprising:

a transformer circuit comprising a plurality of transformers in a quantity denoted by N, each of the transformers having a first secondary winding, having a first output end and a second output end, and a second secondary winding, having a third output end and a fourth output end;

a current balancing circuit comprising a plurality of current balancing units, each of the current balancing units having two output ends, wherein the number of the current balancing units is twice the quantity N of the transformers, and the (2N)th current balancing unit is connected to a fourth output end of the Nth transformer, and the (2N−1)th current balancing unit is connected to a first output end of the Nth transformer; and a light source having a plurality of lamps, each of the lamps having one end connected to a respective output end of the current balancing units and another end grounded, wherein the number of the lamps is four times the quantity N of the transformers.

2. The power system of claim 1, wherein the number of turns of the first and the second secondary windings are the same.

3. The power system of claim 1, further comprising:

a converter circuit connected to the transformer circuit, for converting an input direct current (DC) signal into an alternating current (AC) signal;

a control circuit for controlling the converter circuit to convert the input DC signal into the AC signal; and a feedback circuit connected to the transformer circuit and the control circuit, for feeding a current signal to the control circuit.

4. The power system of claim 3, wherein each of the transformers has a primary winding connected to the converter circuit.

5. The power system of claim 3, wherein the second output end and the third output end of each of the transformers are commonly connected to the feedback circuit.

6. The power system of claim 5, wherein the feedback circuit comprises a plurality of feedback units in a quantity equal to that of the transformers, and each of the feedback units is connected to the second output end of a corresponding one of the transformers.

7. The power system of claim 1, wherein each of the current balancing units has two input ends connected together.

8. The power system of claim 7, wherein each of the current balancing units has two magnetic windings.

9. The power system of claim 8, wherein the two magnetic windings have the same number of turns.

10. The power system of claim 1, wherein each of the current balancing units comprises a common mode choke.

11. A power system for driving a plurality of lamps, comprising:

a transformer circuit comprising a plurality of transformers in a quantity denoted by N, each of the transformers having a first secondary winding, having a first output end and a second output end, a second secondary winding, having a third output end and a fourth output end, and a third secondary winding, having a fifth output end and a sixth output end;

a current balancing circuit comprising a plurality of current balancing units each having two output ends, wherein the number of the current balancing units is twice the quantity N of the transformers, and the (3N)th current balancing unit is connected to a fifth output end of the Nth transformer, the (3N−1)th current balancing unit is connected to a third output end of the Nth transformer, and the (3N−2)th current balancing unit is connected to a first output end of the Nth transformer; and a light source having a plurality of lamps, each of the lamps having one end connected to a respective output end of the current balancing units and another end grounded, wherein the number of the lamps is six times the quantity N of the transformers.

12. The power system of claim 11, wherein the number of turns of the first, the second, and the third secondary windings are the same.

13. The power system of claim 11, further comprising:

a converter circuit connected to the transformer circuit, for converting an input direct current (DC) signal into an alternating current (AC) signal;

a control circuit for controlling the converter circuit to convert the input DC signal into the AC signal; and a feedback circuit connected to the transformer circuit and the control circuit, for feeding a current signal to the control circuit.

14. The power system of claim 13, wherein each of the transformers has a primary winding connected to the converter circuit.

15. The power system of claim 13, wherein the feedback circuit comprises a plurality of feedback units, each of which are respectively connected to the second, the fourth, and the sixth output ends of the transformers, and the number of the feedback units is three times the quantity N of the transformers.

16. The power system of claim 11, wherein each of the current balancing units has two input ends connected together.

17. The power system of claim 16, wherein each of the current balancing units has two magnetic windings having the same numbers of turns.

18. The power system of claim 11, wherein each of the current balancing units comprises a common mode choke.

19. A system for driving a plurality of lamps comprising:

a power source of said system;

a light source comprising a plurality of lamps to be powered by said power source for illumination thereof;

a transformer circuit comprising a plurality of transformers, each transformer of said plurality of transformers comprising a primary winding extending along an input side of said each transformer, and at least two secondary windings jointly extending along an output side of said each transformer, said primary winding electrically connectable to said power source to accept power from said power source, and said at least two secondary windings used to output said power respectively after transforming of said each transformer;

a current balancing circuit comprising a plurality of current balancing units each of which corresponds to one of said at least two secondary windings and at least two lamps from said plurality of lamps of said light source, and electrically connects between said at least two lamps and said one of said at least two secondary windings, said each of said plurality of current balancing units used to accept said transformed power from said one of said at least two secondary windings and to transmit said transformed power to said at least two lamps respectively by means of balancing electrical currents through said each of said plurality of current balancing units.

20. The system of claim 19, wherein said one of said at least two secondary windings defines more than one output end, and one of said more than one output end is electrically connectable to one output end of another of said at least two secondary windings neighboring said one of said at least two secondary windings.

* * * * *